US007998255B2

(12) United States Patent
Blum

(10) Patent No.: US 7,998,255 B2
(45) Date of Patent: Aug. 16, 2011

(54) ELECTROSTATIC PHASE CHANGE GENERATING APPARATUS

(75) Inventor: Dieter Wolfgang Blum, Aldergrove (CA)

(73) Assignee: Convergitech, Inc., San Diego, CA (US)

( * ) Notice: Subject to any disclaimer, the term of this patent is extended or adjusted under 35 U.S.C. 154(b) by 378 days.

(21) Appl. No.: 12/138,077

(22) Filed: Jun. 12, 2008

(65) Prior Publication Data

US 2008/0307963 A1 Dec. 18, 2008

Related U.S. Application Data

(60) Provisional application No. 60/944,141, filed on Jun. 15, 2007.

(51) Int. Cl.
*B03C 3/014* (2006.01)

(52) U.S. Cl. .... 96/52; 95/71; 96/63; 96/354; 261/122.1; 261/124

(58) Field of Classification Search ..... 96/52, 60, 96/62–64, 278, 279, 351–354; 261/122.1, 261/124; 95/64–66, 71, 226; 210/748.1, 210/758

See application file for complete search history.

(56) References Cited

U.S. PATENT DOCUMENTS

| | | | | | |
|---|---|---|---|---|---|
| 808,897 | A | * | 1/1906 | Carrier | 96/356 |
| 1,180,372 | A | * | 4/1916 | Breydel | 422/186.07 |
| 2,209,798 | A | * | 7/1940 | Subkow | 208/350 |
| 2,229,679 | A | * | 1/1941 | Slayter | 422/186.04 |
| 3,479,281 | A | * | 11/1969 | Kikindai et al. | 210/703 |
| 3,750,373 | A | | 8/1973 | Olson | |
| 3,881,894 | A | | 5/1975 | Onufer | |
| 3,967,940 | A | * | 7/1976 | Hirano et al. | 96/52 |
| 4,038,049 | A | * | 7/1977 | Melcher et al. | 95/62 |
| 4,085,170 | A | * | 4/1978 | Simpson et al. | 261/1 |
| 4,090,838 | A | * | 5/1978 | Schena et al. | 431/4 |
| 4,206,396 | A | | 6/1980 | Marks | |
| 4,466,342 | A | | 8/1984 | Basile et al. | |
| 4,548,262 | A | | 10/1985 | Hull | |
| 4,605,626 | A | | 8/1986 | Beck | |
| 4,670,026 | A | | 6/1987 | Hoenig | |

(Continued)

FOREIGN PATENT DOCUMENTS

| | | | | |
|---|---|---|---|---|
| JP | 5-228392 A | * | 9/1993 | 96/52 |
| WO | WO91/09679 | | 7/1991 | |
| WO | WO91/14913 | | 10/1991 | |
| WO | WO 2007/129006 | | 11/2007 | |
| WO | WO2008/018071 | | 2/2008 | |

OTHER PUBLICATIONS

U.S. Appl. No. 12/266,839, filed Nov. 7, 2008, Blum.

(Continued)

*Primary Examiner* — Richard L Chiesa
(74) *Attorney, Agent, or Firm* — Stoel Rives LLP

(57) ABSTRACT

An electrostatic phase change generating apparatus is described. The apparatus causes a change of state to occur in an input gas, for example, ambient air. The electrostatic phase change generating apparatus removes moisture from air, and may be used to generate water from air, dehumidify air, cool air, and the like. The ability to generate water from air has global importance as the need for clean water increases each year. The electrostatic phase change generating apparatus uses high voltage but low current allowing for very energy efficient operations. The electrostatic phase change generating apparatus uses a phase change vessel containing a liquid, a bubbler immersed in the liquid for conveying a gas, and a high voltage source to bias the liquid with respect to an upper electrode.

19 Claims, 7 Drawing Sheets

U.S. PATENT DOCUMENTS

| | | | | |
|---|---|---|---|---|
| 4,671,805 | A | 6/1987 | Gourdine | |
| 5,056,593 | A | 10/1991 | Hull | |
| 5,110,324 | A | 5/1992 | Testone et al. | |
| 5,149,446 | A * | 9/1992 | Reidy | 210/744 |
| 5,284,589 | A | 2/1994 | Tegtmeyer et al. | |
| 6,302,944 | B1 | 10/2001 | Hoenig | |
| 6,657,101 | B1 | 12/2003 | Malmgren et al. | |
| 6,684,648 | B2 | 2/2004 | Faqih | |
| 7,248,003 | B2 | 7/2007 | Krichtafovitch et al. | |
| 7,262,564 | B2 | 8/2007 | Krichtafovitch et al. | |
| 7,410,532 | B2 | 8/2008 | Krichtafovitch et al. | |
| 2001/0029842 | A1 | 10/2001 | Hoenig | |
| 2002/0046569 | A1 | 4/2002 | Faqih | |
| 2006/0226787 | A1 | 10/2006 | Krichtafovitch et al. | |
| 2008/0105127 | A1 | 5/2008 | Brothier et al. | |
| 2008/0307963 | A1 * | 12/2008 | Blum | 95/57 |
| 2009/0114091 | A1 * | 5/2009 | Blum | 95/72 |
| 2009/0230039 | A1 * | 9/2009 | Hoenig et al. | 210/150 |

OTHER PUBLICATIONS

"University of Washington's Eighth Annual Undergraduate Research Symposium: A Celebration of Undergraduates in Research", May 13, 2005.

"Deed Projects Index 1980-2005", American Public Power Association, pp. 7.

Nels Jewell-Larson, "Deed Final Report: Corona Air Pump Project", American Public Power Association, pp. 1-33. Feb. 28, 2005.

M. Arif-uz-Zaman et al., "A Novel Dehumidification Technique Using Electric Field", IEEE Transactions on Industry Applications, vol. 32, No. 1 Jan./Feb. 1996, pp. 36-40.

G. M. Sacha et al., "Induced Water Condensation and Bridge formation by Electric Fields in Atomic Force Microscopy", Material Science Division, Lawrence Berkeley National Laboratory, University of California.

Famin Yang, "Corona-Driven Air Propulsion for Cooling of Microelectronics", University of Washington 2001. 2002.

Henry R. Velkoff et al., "The Effect of an Electrostatic Field on the Condensation of Vapor", Air Force Technical Documentary Report No. RTD-TDR-63-4006 , pp. 1-47. Feb. 1964.

Army: 317 Phase I Selections From the 01.2 Solicitation, Topic No. 1-147, pp. 110-111.

Dr. Chang W. Sohn et al., "Construction Engineering Research Laboratory: Electrostatic Dehumidification Technology", Jan. 8, 2007.

* cited by examiner

ELECTROSTATIC PHASE CHANGE GENERATING APPARATUS

CROSS-REFERENCE TO RELATED PATENT APPLICATIONS

This application claims the benefit of the tiling date of U.S. Provisional Patent Application No. 60/944,141 filed on Jun. 15, 2007.

BACKGROUND OF THE INVENTION

1. Field of the Invention

This invention relates generally to an apparatus for changing the state of a material from gas to liquid, and more particularly to an apparatus for removing water from a source of air.

2. Description of Related Art

The removal of water from air has a number of uses, including dehumidification of air for improved human comfort, industrial and commercial processes, as well as air conditioning and cooling. In recent years, the need for clean water to satisfy basic human needs has increased tremendously. This is due to increased demand for water as a result of both population growth as well as an increase in contaminants and pollution of water due to human activity and pathogens in water. In addition, population growth and economic activities have resulted in increased habitation of dry, arid regions of the planet. These regions often times fall short of an adequate supply of drinking water.

There have been various attempts in the prior art at removing water from air. The most prevalent dehumidification technology uses the condensation of moisture by cooling the air below the saturation temperature by way of the thermodynamic processes of compression and expansion of a coolant. The modern air conditioner, for example, uses this technology. The invention of the air conditioner by Willis Haviland Carrier in upstate New York in 1906 was described in U.S. Pat. No. 808,897 entitled "Apparatus for Treating Air". The basic "Rational Psychrometric Formulae" of Willis Haviland Carrier, as disclosed to the American Society of Mechanical Engineers in 1911, formed the basis of all fundamental calculations for the air conditioning industry, and is still in use today. The techniques invented by Carrier are still by far the most common techniques for removing water from air. Unfortunately, these techniques are also energy intensive, creating pollution through the production of electric power required to run the compressors and refrigeration equipment and also contributing to global climate change. An example of the use of a refrigerant condenser to generate water from air is U.S. Pat. No. 5,149,446 to Reidy, entitled "Potable Water Generator".

Another technique in the prior art to remove water from air is the adsorption of water molecules by a chemical desiccant material. This process requires a regeneration cycle, which is both energy intensive and mechanically complex.

An area of recent interest is that of electrostatic dehumidification technology. Electrostatic collection of water from air uses the basic premise that a water molecule has a dipole moment, and can also be charged. In the presence of a strong electric field, the water molecule will migrate in a predictable direction, and thus be removed from the air. It is noted that the dipole gradient force of the water molecule is relatively weak, but the acquisition of a charge will allow the coulomb force to dominate and react to a strong electric field. Attempts at electrostatic dehumidification technology have used techniques similar to the control of air or liquid flow or the filtering of air using electrostatic principles. Such techniques are disclosed, for example, by Krichtafovitch et al in United States Patent Application Publication US 2006/0226787 A1 entitled "Electrostatic Fluid Accelerator For And Method Of Controlling a Fluid Flow", the entire disclosure of which is incorporated herein by reference. Many of the electrostatic air dehumidifier projects use corona discharge similar to that used in electrostatic filters for removal of particulate matter from an air stream. Such a project was the Corona Air Pump Project submitted to the American Public Power Association and undertaken by Nets Jewell-Larsen at the University of Washington in Seattle, Wash. Unfortunately, the final report on this project dated Feb. 28, 2005 stated that the investigation was unsuccessful at developing a working electrostatic dehumidification prototype for molecular-water level dehumidification. The use of the action of a strong electric field on water molecules, and the interaction of forces to cause the migration of water molecules or droplets, is little understood, and is the topic of research.

It is therefore an object of the present invention to provide an apparatus that removes water from air without the use of energy intensive mechanical cooling. It is another object of the present invention to provide an apparatus that removes water from air without the use of chemical desiccants. It is yet another object of the present invention to provide an apparatus that removes water from air using electrostatic principles but without corona discharge. It is yet another object of the present invention to provide a highly energy efficient apparatus for removing water from air.

BRIEF SUMMARY OF THE INVENTION

In accordance with the present invention, there is provided an electrostatic phase change generating apparatus comprising a phase change vessel containing a liquid, a bubbler immersed in the liquid for conveying a gas, and a high voltage source to bias the liquid with respect to an upper electrode. The apparatus may be used, for example, to generate fresh water from air, reduce the humidity of an input air stream, desalinate salt water, and the like.

The foregoing paragraph has been provided by way of introduction, and is not intended to limit the scope of the invention as described by this specification, drawings and claims.

BRIEF DESCRIPTION OF THE DRAWINGS

The invention will be described by reference to the following drawings, in which like numerals refer to like elements, and in which.

Figure 1A:
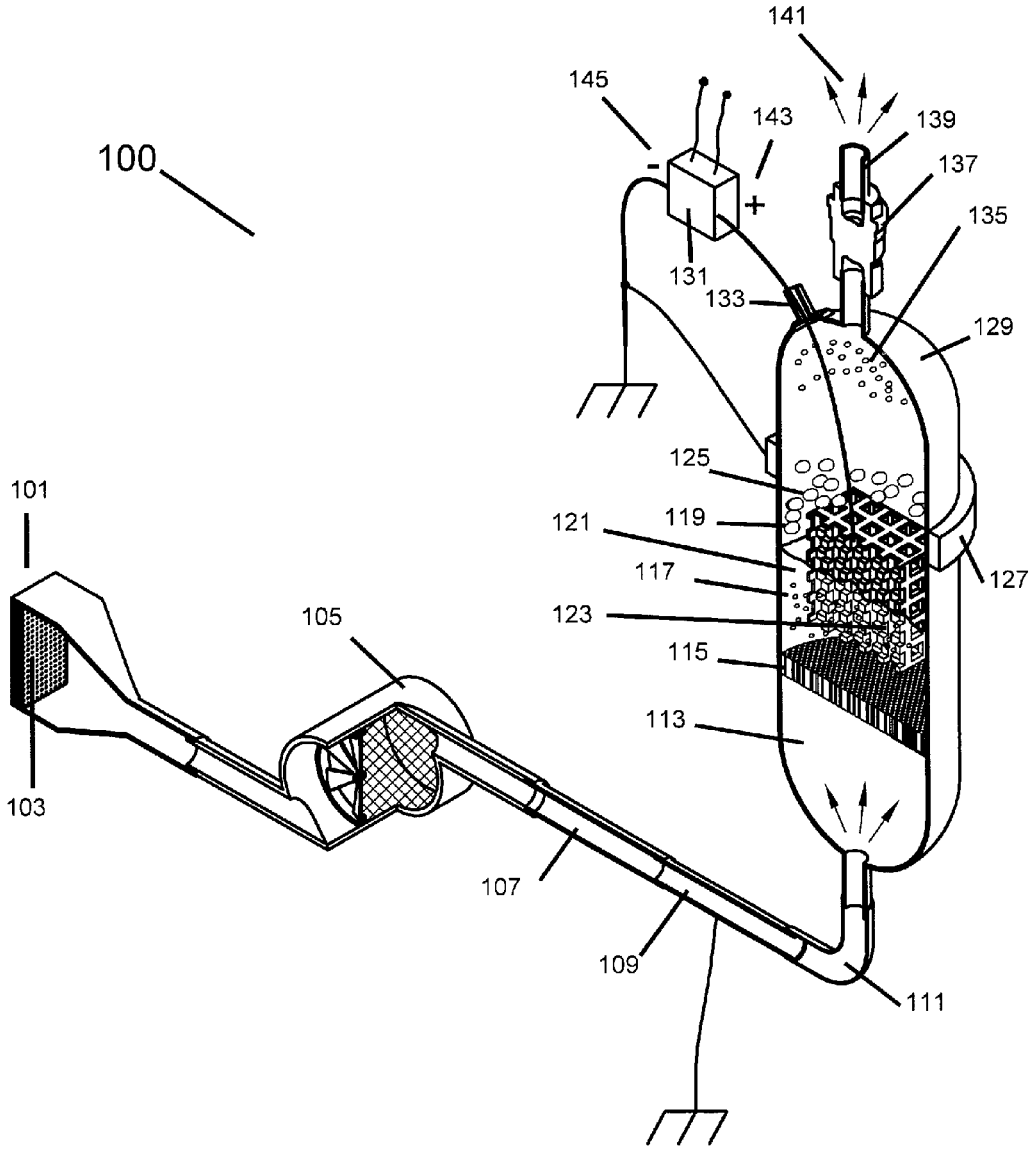
FIG. 1A is a perspective cutaway view of the electrostatic phase change generating apparatus.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, drawings and claims.

DESCRIPTION OF THE PREFERRED EMBODIMENTS

For a general understanding of the present invention, reference is made to the drawings. In the drawings, like reference numerals have been used throughout to designate identical elements.

The electrostatic phase change generating apparatus, as depicted in the drawings and described in this specification, uses water as an exemplary application of the apparatus. It should be noted, however, that other materials may also be used that exhibit polar electronic bond structures. Wafer has a polar bond structure between oxygen and hydrogen that provides for attraction of the water molecules using an electric field. In the specific example of water, removal of water molecules from a gaseous stream (such as, for example, ambient air) and subsequent electrostatic condensation of the water molecules has widespread commercial value. Dehumidification of air is one application, but another application that may prove immensely valuable to human civilization is the extraction of clean drinking water from ambient air. Water is essential for all life, and the use of ambient air as an abundant and plentiful source of clean drinking water has unsurpassed benefits to humanity. To convert air to water using very little electrical power makes the apparatus of the present invention all the more beneficial. The apparatus of the present invention converts gases to liquids using a novel adiabatic process. As will be described by way of the drawings, a novel use of electrostatic forces in a vessel where the incoming gas is bubbled through a charged polar liquid (such as water) has not been described or attempted in the prior art, and efficiently changes a gaseous state to a liquid state in a polar liquid. Such an apparatus could also be used for cooling through the use of the thermodynamic properties of gas-liquid and liquid-gas state changes. In addition, the apparatus of the present invention may be used for purification of water in applications such as desalination and the like. In U.S. provisional application for patent application No. 61/036,912, filed on Mar. 14, 2008, to Dr. Stuart Alfred Hoenig, entitled "Electrostatic Desalination And Water Purification", the entire disclosure of which is incorporated herein by reference, the use of electrostatics and the bubbling of salt water is disclosed as a novel desalination technique. The use of the present invention, and various improvements thereupon, to replace the cooling stage of the Hoenig invention, would result in lower energy consumption and improved efficiencies. In addition, the present invention may be used for desalination by replacing the water in the electrostatic phase change generating apparatus with salt water.

Now turning to the drawings, FIG. 1A is a perspective cutaway view of the electrostatic phase change generating apparatus 100. Referring to FIG. 1A, a phase-change vessel 129 is depicted. The vessel 129 is shown as a cylindrical structure with hemispherical ends, but other shapes and sizes may be used as well. Larger vessels may be used to increase throughput of the apparatus, for example. The phase-change vessel 129 is made of a non-conductive or dielectric material such as fiberglass, polypropylene, polycarbonate, a plastic, or the like. In the example of water production from ambient air, air is pulled into the apparatus through an air intake 101 that may, in some embodiments of the present invention, contain an optional intake particulate filter 103. The intake particulate filter 103 may be sized to accommodate the specific environmental situation where the apparatus of the present invention is used. The intake particulate filter 103 may be cloth, glass mesh, pleated paper, foam, or any other suitable material known to remove particulates from an airstream. Ambient or process air is pulled into the apparatus through the air intake 101 by way of a blower 105. The blower 105 may be any gas handling device suitable for moving a volume of gas such as air, and may be, for example, a blower, a centrifugal blower, a mechanical rotary vane pump, a piston pump, an actuated plunger pump, or the like. Once the gas (such as ambient air) is pulled through the blower 105, it travels through a first dielectric tube 107 and a second dielectric tube 111 that are joined by a tube 109 that may, in some embodiments of the present invention, be conductive and be electrically connected to a positive source, a negative source, or ground. This arrangement serves to bias or neutralize the incoming airstream. The first dielectric tube 107 and the second dielectric tube 111 may be made from, for example, nylon, silicone, polycarbonate, poly vinyl chloride, or the like. The tube 109 may be made from a conductive material such as, for example, copper, brass, iron, or the like. The couplings between the dielectric tubes 107 and 111 and the tube 109 are preferably air tight, and may use hose clamps, barb fittings, threaded fittings, glued fittings, compression fittings, quick release o-ring fittings, or any other mechanical connection means that are suitable for such purpose. Now looking at the phase-change vessel 129 in FIG. 1, the dielectric tube 111 is connected to a fitting on the phase-change vessel 129 using an air tight connection technique such as hose clamps, barb fittings, threaded fittings, glued fittings, compression fittings, quick release o-ring fittings, or the like. This coupling of the dielectric tube 111 to the phase-change vessel allows air under pressure 113 to reside in the phase-change vessel 129 at a proximate low point in the phase-change vessel 129. Above the air under pressure 113 is a porous bubbler 115 that is physically and mechanically coupled to the sides of the phase-change vessel 129 in such a way as to prevent the water above the porous bubbler from entering the air under pressure 113. The porous bubbler 115 may be made from a porous polymer, a ceramic membrane, sintered metal such as stainless steel, brass, or the like, a metal mesh, a hydrophilic material or the like. The surface of the porous bubbler 115 contains a plurality of small orifices of sufficient spacing to generate a stream of small bubbles in the water above the porous bubbler 115. As the air under pressure 113 travels through the porous bubbler 115, bubbles are generated in the water 121 above, it should be noted that the water 121 is considered "seed water" necessary for the formation of bubbles in the apparatus of the present invention. As water is removed from the airstream, the water 121 will grow in volume, necessitating removal through a pump; siphon, spillway, gate valve, manual removal or other techniques for transferring a liquid that are well known to those skilled in the art. Submersed in the water 121 is a high voltage grid 123 for imparting a potential to the water 121. The high voltage grid 123 is made from a conductive material such as a metal. The grid may also be integrated with, or be, the porous bubbler 115. It may be a grid as depicted in FIG. 1, or it may have another shape such as a matrix, helix, or any other shape sufficient to impart a potential to the water 121. The high voltage grid 123 is electrically connected to a high voltage lead 143 of the high voltage power supply 131 that is capable of generating a potential of 10 to about 30 kilovolts or higher. A positive potential may be applied to the seed water 121 with a negative potential applied to the upper electrode 127, or the polarities may be reversed in some embodiments and applications of the present invention. The high voltage applied to the electrostatic phase change generating apparatus 100 should be below the potential where corona discharge occurs. An example of such a high voltage power supply is the Spellman MP series or the Bertran 230 by Spellman High Voltage Electronics Corporation, Hauppauge, N.Y. EMCO High Voltage Corporation also manufacturers high voltage power supplies that may be used. Other high voltage sources may also be used, including, for example, photovoltaic cells with appropriate high voltage step up circuitry. A high voltage lead 145 of the high voltage power supply 131 is connected to an upper electrode 127 that, as shown in the figures, is on the outside of the phase-change vessel 129, but may also, in some embodiments of the present invention, be on the inside of the phase-change vessel 129. The upper electrode 127 is made from an electrically conductive material such as copper, brass, aluminum, or the like. The phase-change vessel 129 also contains a feed-through 133 for the passage of wires and the like. As the air bubbles 117 pass through the water 121 that has been driven to a high voltage potential, and break the surface of the water 121, the water molecules that were contained within the bubbles interact with the applied electric field generated by the upper electrode 127 and form electrostatic condensation 125 on the walls of the phase-change vessel 129, or in the case of an interior upper electrode, on the upper electrode itself. The electrostatic condensation 125 and 135 will run down the sides of the phase-change vessel 129 or drop into and combine with the water 121. The production of water from the intake air stream will require the removal of produced water to allow for further water production. A volume of seed water is always required, however, to provide for continued water production from air. As the electrostatic phase change generating apparatus continues to produce water from air, the dehumidified air travels through a vent release valve 137 and a vent 139, releasing vented dehumidified air to the environment. In some embodiments of the present invention, the vented dehumidified air 141 may be fed back to the air intake 101 for further removal of water from the vented dehumidified air 141. It should be noted that other materials may be used in place of the seed water and connected to a high voltage source.

Figure 1B:
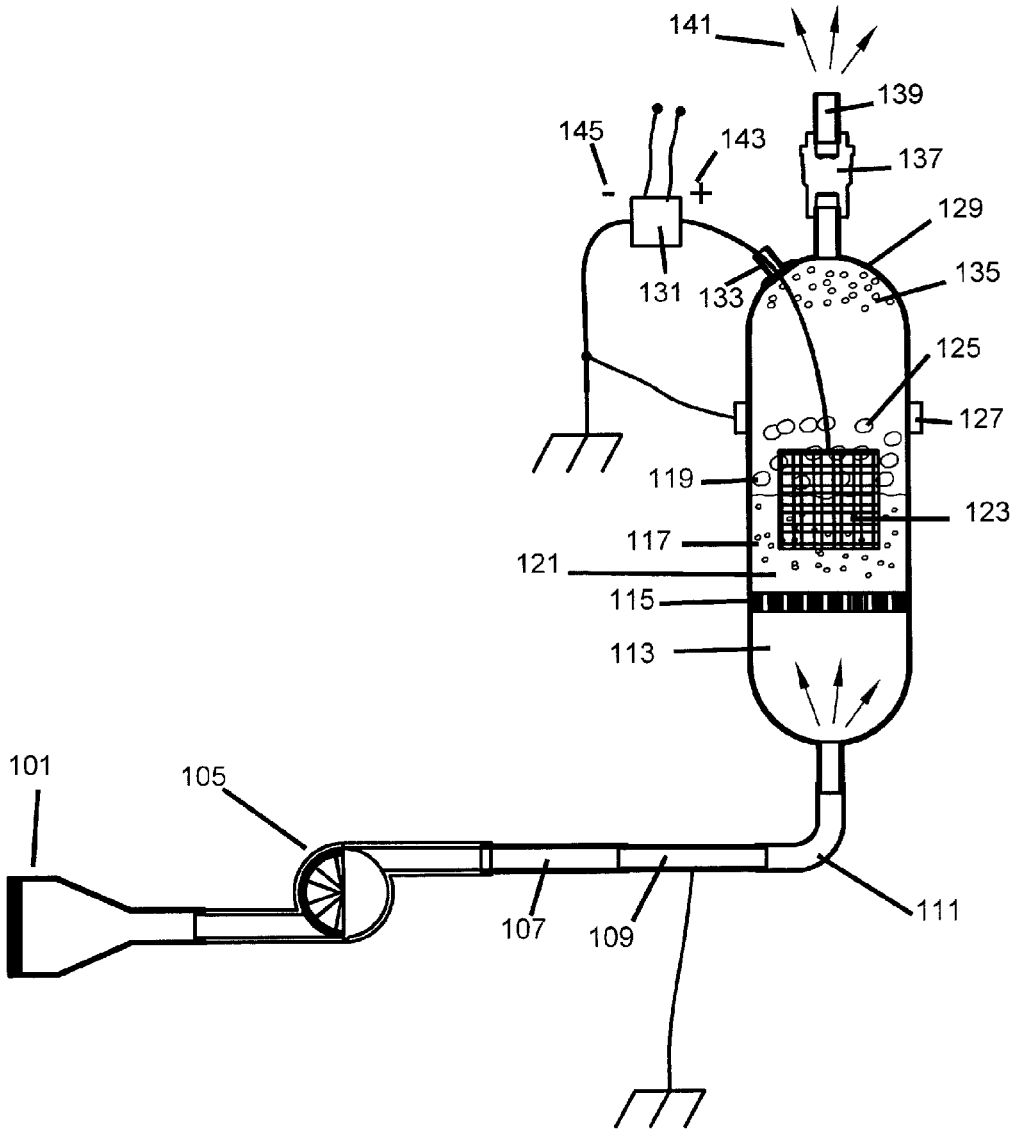
FIG. 1B is a partially cutaway plan view of the electrostatic phase change generating apparatus.
Figure 1C:
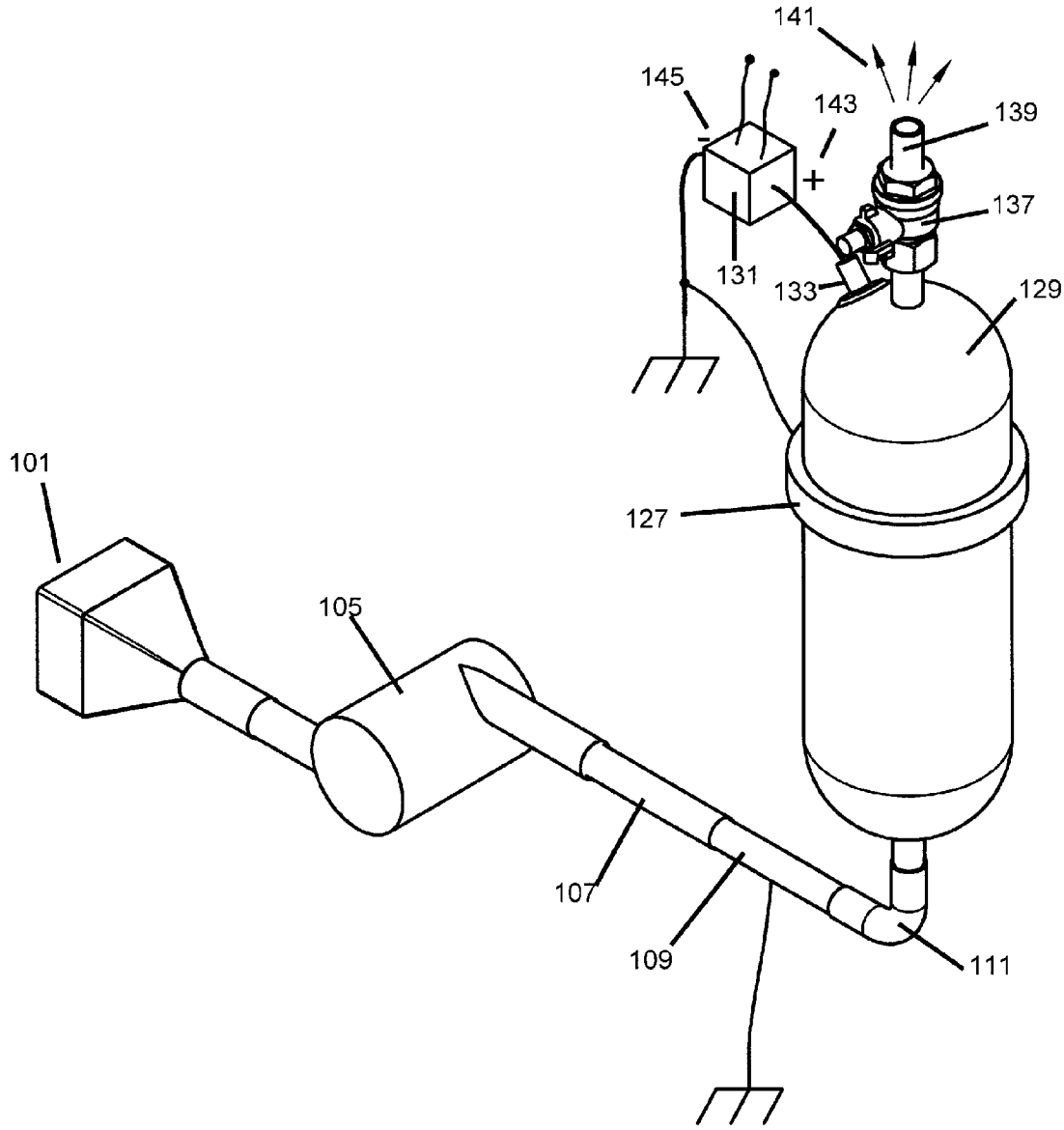
FIG. 1C is a perspective view of the electrostatic phase change generating apparatus.
Figure 1D:
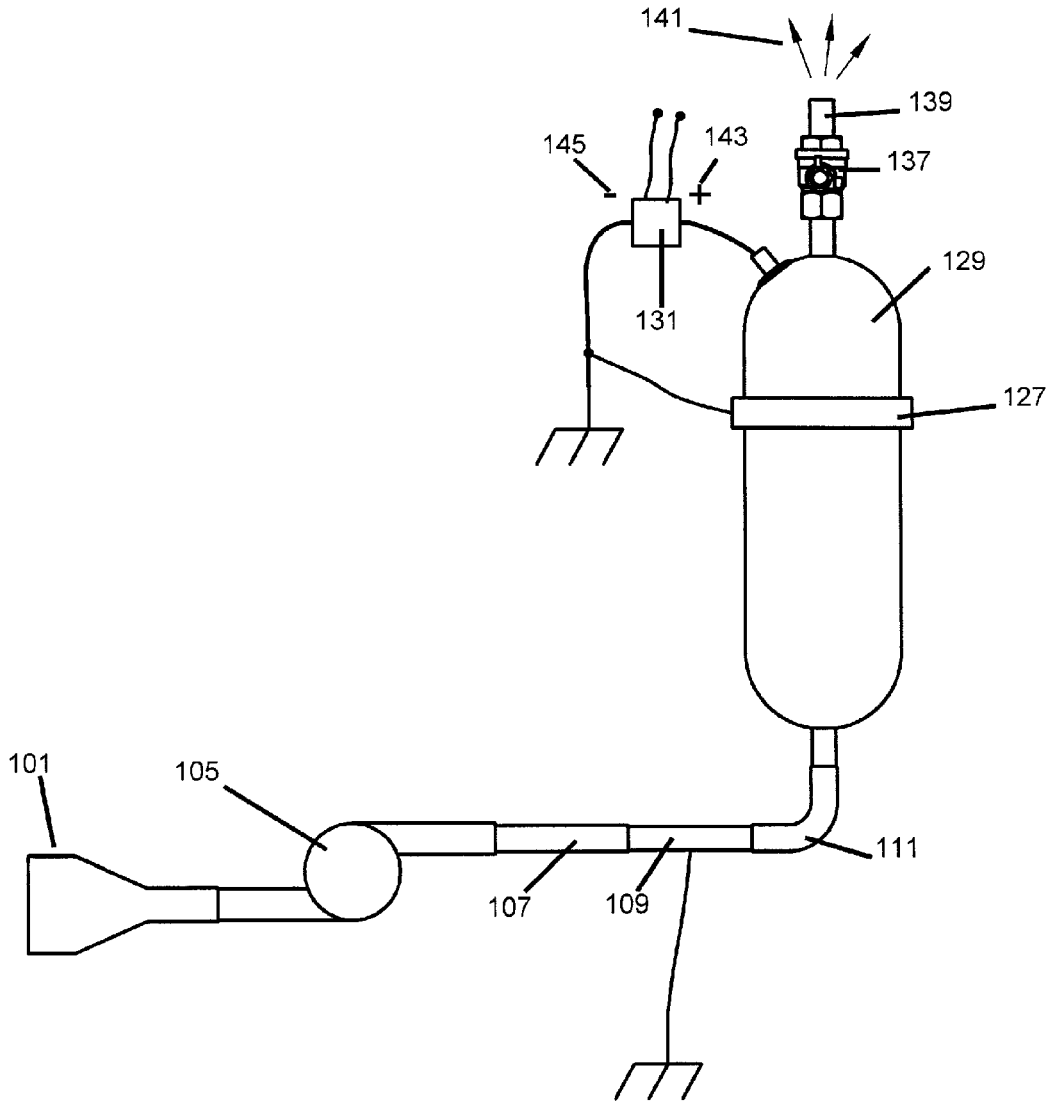
FIG. 1D is a plan view of the electrostatic phase change generating apparatus.
Figure 1E:
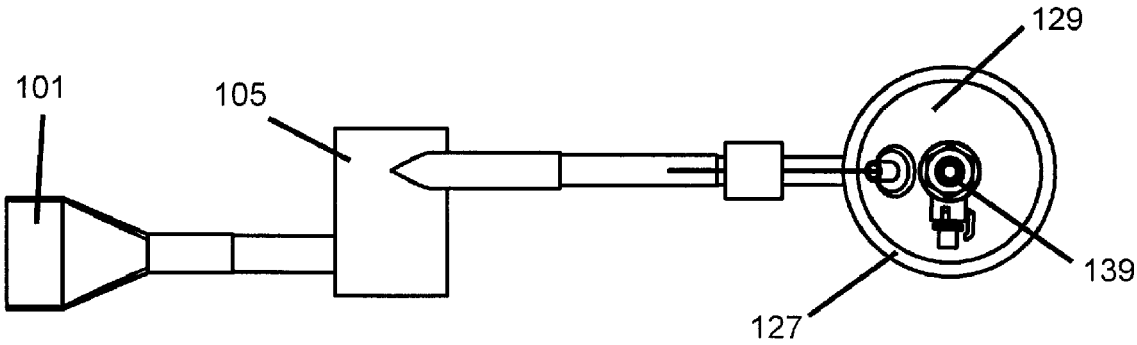
FIG. 1E is a top plan view of the electrostatic phase change generating apparatus.

For complete understanding of the present invention, additional views of the electrostatic phase change generating apparatus are depicted in FIGS. 1B, 1C, 1D and 1E. FIG. 1B is a partially cutaway plan view of the electrostatic phase change generating apparatus. FIG. 1C is a perspective view of the electrostatic phase change generating apparatus. FIG. 1D is a plan view of the electrostatic phase change generating apparatus, and FIG. 1E is a top plan view of the electrostatic phase change generating apparatus.

Figure 2:
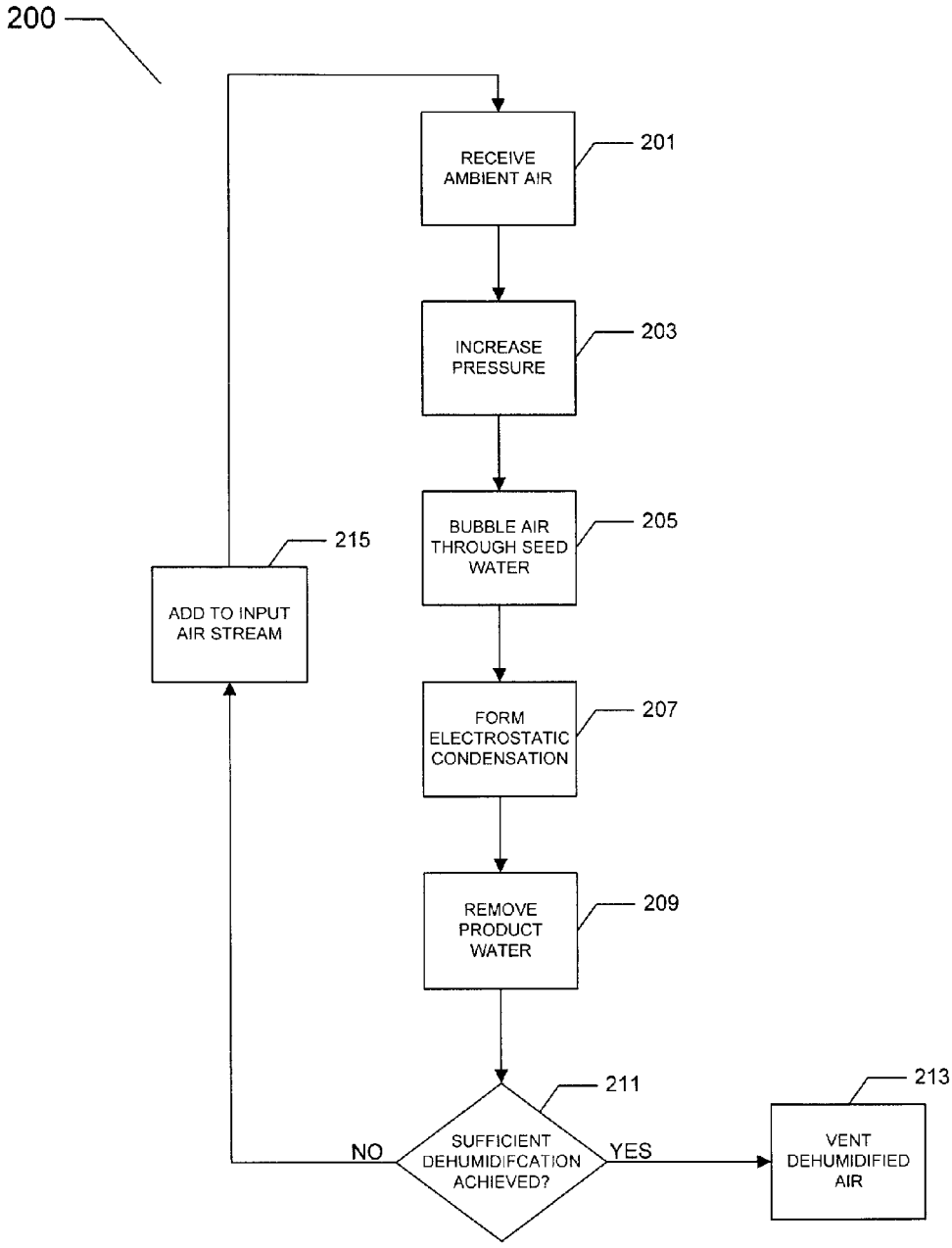
FIG. 2 is a flowchart depicting a process for removing water from air.

Referring now to FIG. 2, a flowchart depicting a process for removing water from air using the electrostatic phase change generating apparatus of the present invention is shown. In step 201, ambient air is received by the apparatus of the present invention. In step 203, pressure of the incoming air stream is increased as it enters the apparatus of the present invention. In step 205, the pressurized air is bubbled through seed water. Seed water is water within the apparatus of the present invention that is used for making more water from the air stream, and has a high voltage potential applied to it, as described previously by way of FIG. 1. As the air is bubbled through the seed water in step 205, the presence of an upper electrode with an applied potential difference between the upper electrode and the seed water causes electrostatic condensation to form in step 207. This electrostatic condensation is product water that has been derived from the air, and can be removed in step 209 for drinking or other purposes. In step 211 if sufficient dehumidification of the incoming airstream has been achieved, the dehumidified air is vented in step 213. If sufficient, dehumidification of the incoming airstream has not been achieved in step 211, the resulting airstream is added to the input airstream in step 215 and the process begins again at step 201, until such time as sufficient dehumidification is achieved. It should be noted that the products of the present invention may be either liquid or gas, such as drinking water or conditioned air.

Figure 3:
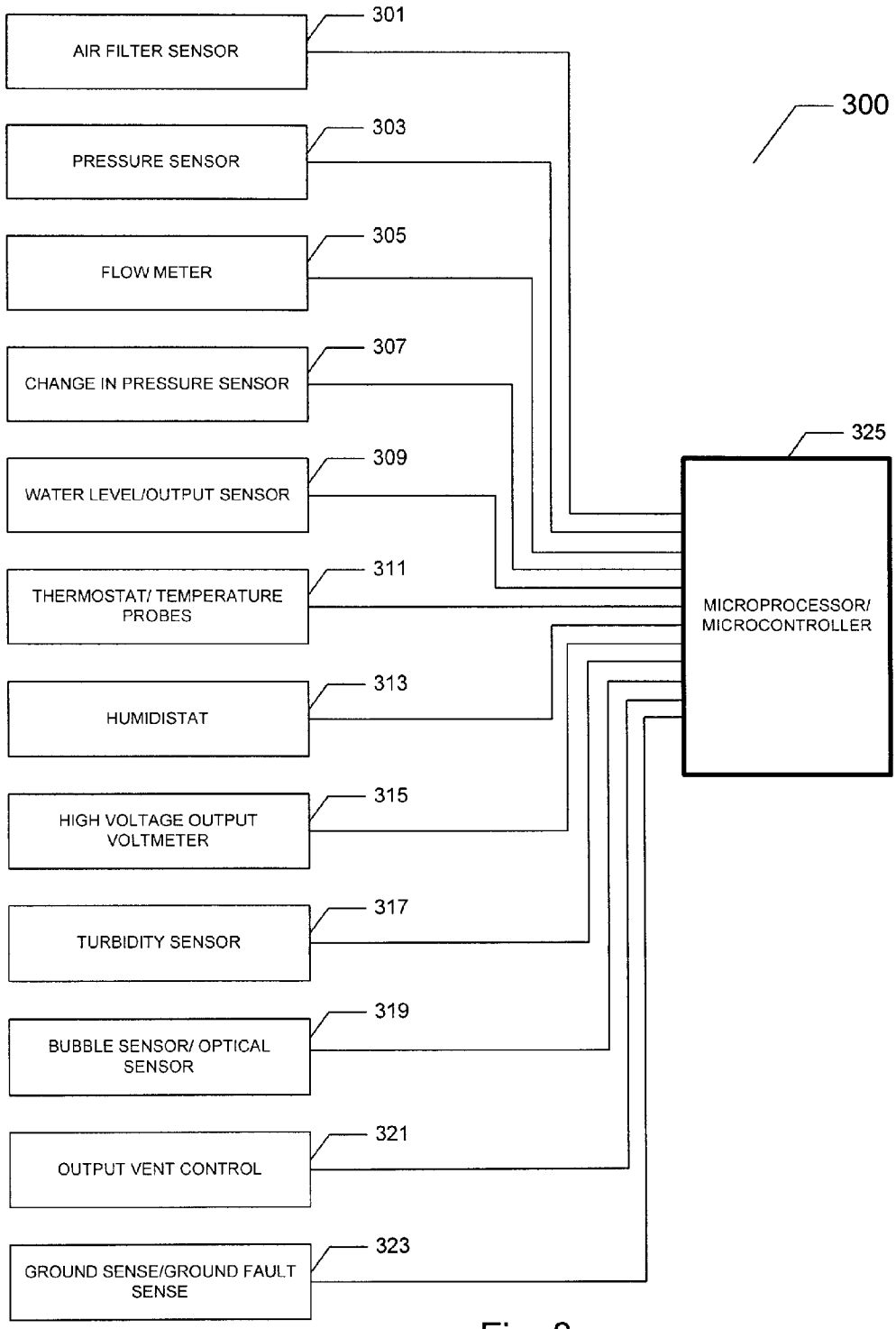
FIG. 3 is a functional diagram of exemplary control elements for the electrostatic phase change generating apparatus.

Lastly, in FIG. 3, a functional diagram of exemplary control elements for the electrostatic phase change generating apparatus are depicted. Some or all of these control elements may be used to assist with the process of making water from air. The control elements may interface with a microprocessor or microcontroller 325. Control elements may include an air filter sensor 301, a pressure sensor 303, a flow meter 305, a change in pressure sensor 307, a water level/output sensor 300, a thermostat/temperature probe 311, a humidistat 313, a high voltage output voltmeter 315, a turbidity sensor 317, a bubble sensor/optical sensor 319, an output vent control 321, a ground sense/ground fault sense 323, and the like. Other control and sensing elements may become evident to those skilled in the art after reading this specification and claims and reviewing the attached drawings.

It is, therefore, apparent that there has been provided, in accordance with the various objects of the present invention, an electrostatic phase change generating apparatus. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the present invention as defined by this specification, drawings and claims.

What is claimed is:

1. An electrostatic phase change generating apparatus comprising:

a phase change vessel containing a liquid;

a lower electrode immersed in the liquid;

an upper electrode separated from the lower electrode;

a bubbler operatively coupled to a source of gas and immersed in the liquid;

a high voltage power supply where one potential side of the high voltage power supply is connected to the lower electrode and the other potential side of the high voltage power supply is connected to the upper electrode;

a vent for releasing gas that has been processed by the electrostatic phase change generating apparatus; and a means for removing liquid generated by the electrostatic phase change generating apparatus.

2. The electrostatic phase change generating apparatus as recited in claim 1, wherein the lower electrode and the bubbler are structurally and electrically integrated.

3. The electrostatic phase change generating apparatus as recited in claim 1, wherein the lower electrode and the bubbler are made from a sintered metal.

4. The electrostatic phase change generating apparatus as recited in claim 1, wherein the lower electrode and the bubbler are made from sintered stainless steel.

5. The electrostatic phase change generating apparatus as recited in claim 1, wherein the lower electrode is electrically connected to a positive potential on the high voltage power supply and the upper electrode is electrically connected to a negative potential on the high voltage power supply.

6. The electrostatic phase change generating apparatus as recited in claim 1, wherein the lower electrode is electrically connected to a negative potential on the high voltage power supply and the upper electrode is electrically connected to a positive potential on the high voltage power supply.

7. The electrostatic phase change generating apparatus as recited in claim 1, wherein the liquid is water.

8. The electrostatic phase change generating apparatus as recited in claim 1, wherein the liquid is salt water.

9. The electrostatic phase change generating apparatus as recited in claim 1, wherein the gas is air.

10. The electrostatic phase change generating apparatus as recited in claim 1, wherein the gas is ambient air.

11. The electrostatic phase change generating apparatus as recited in claim 1, further comprising a blower to move the source of gas through the bubbler.

12. The electrostatic phase change generating apparatus as recited in claim 1, further comprising an intake filter to purify the gas entering the electrostatic phase change generating apparatus.

13. The electrostatic phase change generating apparatus as recited in claim 1, further comprising a conductive element to impart a ground or a bias on gas entering the electrostatic phase change generating apparatus.

14. The electrostatic phase change generating apparatus as recited in claim 1, wherein the high voltage power supply output is direct current.

15. The electrostatic phase change generating apparatus as recited in claim 1, wherein the high voltage power supply output is direct current positive.

16. The electrostatic phase change generating apparatus as recited in claim 1, wherein the high voltage power supply output is direct current negative.

17. The electrostatic phase change generating apparatus as recited in claim 1, wherein the high voltage power supply is pulsed direct current.

18. The electrostatic phase change generating apparatus as recited in claim 1, wherein the high voltage power supply output has an alternating current component.

19. The electrostatic phase change generating apparatus as recited in claim 1, wherein the high voltage power supply output is modulated.

* * * * *